US008812223B2

(12) United States Patent
Durham et al.

(10) Patent No.: US 8,812,223 B2
(45) Date of Patent: Aug. 19, 2014

(54) SYSTEMS AND METHODS FOR ALERTING AIRCRAFT CREW MEMBERS OF A RUNWAY ASSIGNMENT FOR AN AIRCRAFT TAKEOFF SEQUENCE

(75) Inventors: Billy J. Durham, Glendale, AZ (US); Brian J. Smith, Glendale, AZ (US)

(73) Assignee: Honeywell International Inc., Morristown, NJ (US)

( * ) Notice: Subject to any disclaimer, the term of this patent is extended or adjusted under 35 U.S.C. 154(b) by 2084 days.

(21) Appl. No.: 11/656,680

(22) Filed: Jan. 23, 2007

(65) Prior Publication Data

US 2010/0274468 A1 Oct. 28, 2010

(51) Int. Cl.
*G08G 5/00* (2006.01)

(52) U.S. Cl.
USPC ..... 701/120; 701/15

(58) Field of Classification Search
USPC ..... 701/15, 120; 340/959, 961, 972; 342/456
See application file for complete search history.

(56) References Cited

U.S. PATENT DOCUMENTS

| | | | | |
|---|---|---|---|---|
| 5,629,691 | A * | 5/1997 | Jain | 340/961 |
| 6,185,486 | B1 * | 2/2001 | Labounsky et al. | 701/15 |
| 6,381,541 | B1 | 4/2002 | Sadler | |
| 6,453,231 | B1 * | 9/2002 | Ooga | 701/120 |
| 6,486,825 | B1 | 11/2002 | Smithey | |
| 6,606,563 | B2 | 8/2003 | Corcoran, III | |
| 6,614,397 | B2 | 9/2003 | Pullen et al. | |
| RE38,584 | E * | 9/2004 | Robinson | 340/601 |
| 6,862,519 | B2 | 3/2005 | Walter | |
| 6,950,037 | B1 * | 9/2005 | Clavier et al. | 340/945 |
| 7,079,951 | B2 | 7/2006 | Conner et al. | |
| 7,385,527 | B1 * | 6/2008 | Clavier et al. | 340/945 |
| 7,555,372 | B2 * | 6/2009 | Dwyer | 701/16 |
| 7,796,055 | B2 * | 9/2010 | Clark et al. | 340/972 |
| 2002/0042673 | A1 * | 4/2002 | Ooga | 701/120 |
| 2003/0033084 | A1 * | 2/2003 | Corcoran, III | 701/301 |
| 2003/0090420 | A1 * | 5/2003 | Pullen et al. | 342/454 |
| 2003/0102987 | A1 | 6/2003 | Walter | |
| 2003/0105581 | A1 | 6/2003 | Walter | |
| 2004/0225440 | A1 | 11/2004 | Khatwa et al. | |
| 2005/0015202 | A1 | 1/2005 | Poe et al. | |

(Continued)

OTHER PUBLICATIONS

GPS and Runway Incursion [online]. [retrieved on Oct. 27, 2006]. Retrieved from Internet: <URL:www.cockpitgps.com/incursion/gps_and_runway_incursion.htm>.

(Continued)

*Primary Examiner* — Helal A Algahaim
*Assistant Examiner* — Charles J Han
(74) *Attorney, Agent, or Firm* — Ingrassia Fisher & Lorenz, P.C.

(57) ABSTRACT

System and methods are provided alerting an aircraft crew member of a runway assignment for an aircraft takeoff sequence from a runway of an airport having a plurality of runways. In an embodiment, the method includes transmitting data comprising data relating to the runway assignment and data relating to an open status or a closed status for each airport runway to an aircraft data receiver, and transmitting an audio signal indicating the runway assignment to an aircraft audio receiver. In another embodiment, the method includes receiving an audio signal indicating the runway assignment from a control tower audio transmitter, receiving data comprising data relating to the runway assignment and data relating to an open status or a closed status of each of the airport runways from a control tower data transmitter, processing the received data, and displaying the received data relating to the runway assignment on a display.

7 Claims, 6 Drawing Sheets

(56) References Cited

U.S. PATENT DOCUMENTS

| | | | | |
|---|---|---|---|---|
| 2005/0128129 | A1* | 6/2005 | Conner et al. | 342/36 |
| 2006/0007035 | A1 | 1/2006 | Corrigan | |
| 2006/0008087 | A1 | 1/2006 | Olive | |
| 2006/0114124 | A1 | 6/2006 | Vickas | |
| 2006/0214816 | A1 | 9/2006 | Schell | |
| 2007/0061055 | A1* | 3/2007 | Stone et al. | 701/2 |
| 2007/0250224 | A1* | 10/2007 | Dwyer | 701/16 |
| 2008/0045198 | A1* | 2/2008 | Bhogal et al. | 455/414.4 |
| 2008/0065275 | A1* | 3/2008 | Vizzini | 701/2 |
| 2008/0106438 | A1* | 5/2008 | Clark et al. | 340/972 |
| 2008/0109163 | A1* | 5/2008 | Stone et al. | 701/211 |
| 2008/0154445 | A1* | 6/2008 | Goodman et al. | 701/3 |
| 2008/0215198 | A1* | 9/2008 | Richards | 701/15 |
| 2010/0076628 | A1* | 3/2010 | Boorman et al. | 701/11 |

OTHER PUBLICATIONS

Five Crash-Free Years End With Stunning Blunder [online]. [retrieved on Oct. 27, 2006]. Retrieved from Internet:<URL:blogs.usatoday.com/oped/2006/08/five_crashfree_.html>.

Tech Watch: One Wrong Turn [online]. [retrieved Oct. 27, 2006]. Retrieved from Internet: <popularmechanics.com/technology/industry/4199546.html>.

* cited by examiner

SYSTEMS AND METHODS FOR ALERTING AIRCRAFT CREW MEMBERS OF A RUNWAY ASSIGNMENT FOR AN AIRCRAFT TAKEOFF SEQUENCE

TECHNICAL FIELD

The inventive subject matter generally relates to systems and methods for alerting aircraft crew members of a runway assignment for an aircraft takeoff sequence.

BACKGROUND

Before an aircraft begins a takeoff sequence, the aircraft is assigned a runway from an air traffic controller. The air traffic controller typically communicates the runway assignment to a pilot of the aircraft either through a radio or other audible means. Once the pilot receives the runway assignment, he then proceeds to the assigned runway to begin the takeoff sequence.

Although this runway assignment procedure is generally safe, it may have certain drawbacks. As air traffic and air traffic controller workload increases, human errors may increase as well. For example, an air traffic controller may inadvertently communicate an incorrect runway assignment to a pilot, and the pilot may maneuver the aircraft to the runway and find another aircraft on the assigned runway. The presence of the pilot's aircraft at the incorrect runway may cause an air traffic delay. Additionally, if a new takeoff runway is assigned to the aircraft, additional time may be needed to move the aircraft to the new runway thereby causing additional air traffic delay. In other cases, an air traffic controller may assign a runway to an aircraft, and the runway may be under repair or otherwise unavailable. Thus, if the pilot proceeds to the runway and finds the runway unavailable, delays may similarly occur.

Accordingly, it is desirable to have a system and method for alerting aircraft crew members of a runway assignment for an aircraft takeoff sequence that reduces air traffic delays. In addition, it is desirable for the system and method to be relatively simple to implement into existing systems. Furthermore, other desirable features and characteristics of the inventive subject matter will become apparent from the subsequent detailed description of the inventive subject matter and the appended claims, taken in conjunction with the accompanying drawings and this background of the inventive subject matter.

BRIEF SUMMARY

A method, in accordance with an embodiment, is provided for alerting an aircraft crew member of a runway assignment for an aircraft takeoff sequence from a runway of an airport, where the airport has a plurality of runways. The method includes transmitting a first set of data to a data receiver on the aircraft, the first set of data comprising data relating to the runway assignment and data relating to an open status or a closed status for each airport runway, and transmitting a first audio signal to an audio receiver on an aircraft, the first audio signal indicating the runway assignment.

In accordance with another embodiment, the method includes receiving a first audio signal from an audio transmitter at a control tower, the first audio signal indicating the runway assignment. The method also includes receiving a first set of data from a data transmitter at the control tower, the first set of data comprising data relating to the runway assignment and data relating to an open status or a closed status of each of the airport runways. Additionally, the method includes processing the received first set of data. The method also includes displaying the received data relating to the runway assignment on a display.

In accordance with still another embodiment, a system is provided that alerts an aircraft crew member of a runway assignment for an aircraft takeoff sequence from a runway of an airport having a plurality of runways. The system is configured to be disposed within the aircraft. The system includes a processor adapted to receive data relating to the runway assignment and data relating to an open status or a closed status of each runway of the plurality of runways and operable, in response thereto, to supply one or more image rendering display commands.

BRIEF DESCRIPTION OF THE DRAWINGS

The inventive subject matter will hereinafter be described in conjunction with the following drawing figures, wherein like numerals denote like elements.

DETAILED DESCRIPTION

The following detailed description of the inventive subject matter is merely exemplary in nature and is not intended to limit the inventive subject matter or the application and uses of the inventive subject matter. Furthermore, there is no intention to be bound by any theory presented in the preceding background of the inventive subject matter or the following detailed description of the inventive subject matter.

Figure 1:
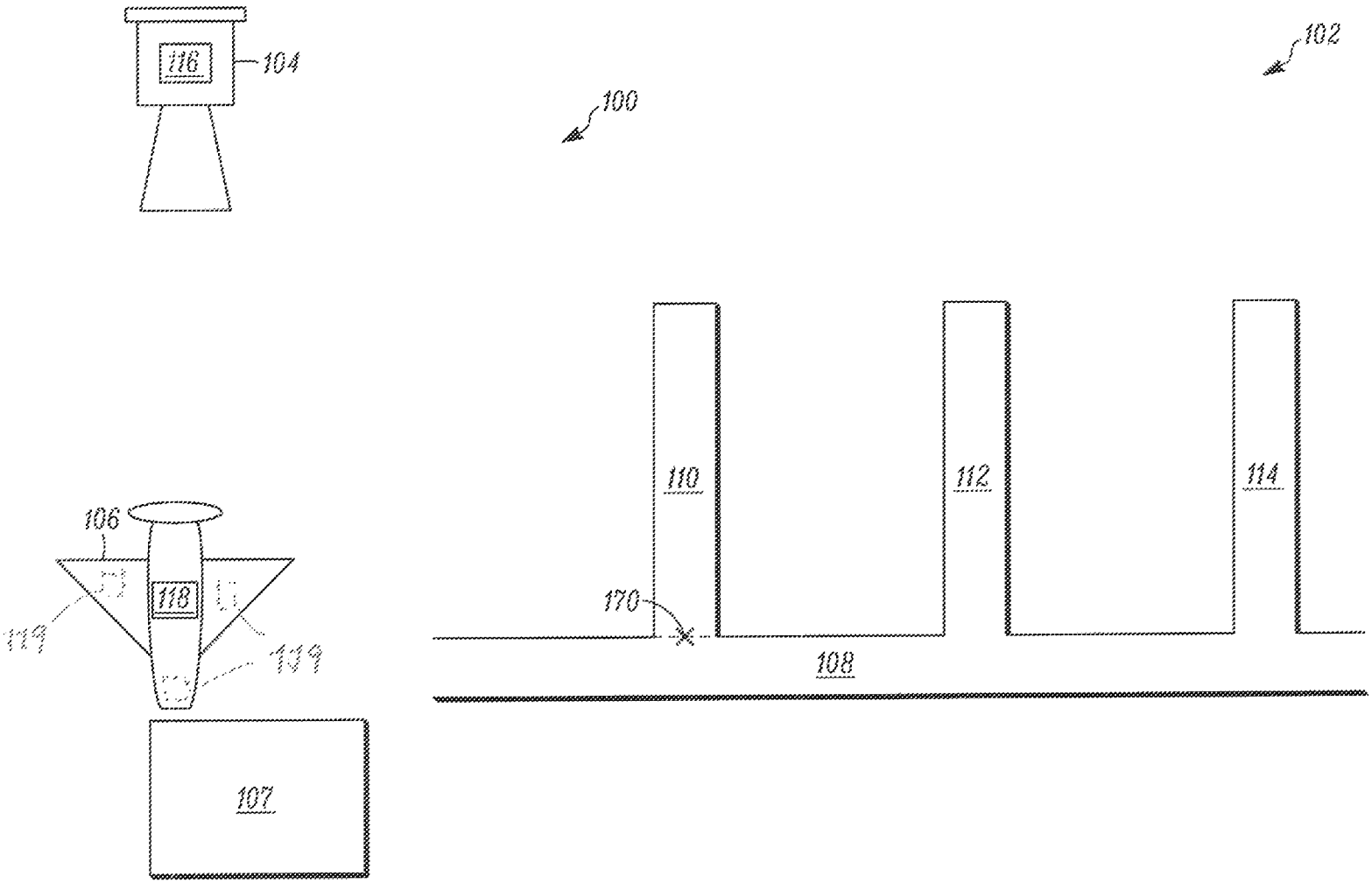
FIG. 1 is a schematic of a system for alerting aircraft crew members of a runway assignment for an aircraft takeoff sequence, according to an embodiment.

Turning now to the description, and with reference to FIG. 1, a schematic of a system 100 for alerting aircraft crew members of a runway assignment for an aircraft takeoff sequence is depicted, according to an embodiment. The system 100 is shown implemented in an airport 102 having a control tower 104, an aircraft 106, a terminal 107, a taxiway 108, and runways 110, 112, 114. It will be appreciated that more terminals and taxiways, and fewer or more runways may alternatively be incorporated in other embodiments.

The system 100 includes a control tower system 116 and an aircraft system 118 that are configured to communicate data between each other. The control tower system 116 is incorporated into the control tower 104 and, as shown in a functional block diagram in FIG. 2, includes at least one user station 120 at which an air traffic controller 122, may be located. The user station 120 may have a user interface 124, a control tower processor 126, one or more runway-status related databases 128, a control tower display device 130, a data communications link 132, and an audio communications link 134. The user interface 124 may be any one, or combination, of various known user interface devices including, but not limited to, a cursor control device (CCD), such as a mouse, a trackball, or joystick, and/or a keyboard, one or more buttons, switches, or knobs. The air traffic controller 122 uses the user interface 124 to, among other things, move a cursor symbol on the control tower display device 130, input various data, or select a runway to read/change its status.

The control tower processor 126 is in operable communication with the one or more data bases 128 via, for example, a communication bus 136. In addition, the control tower processor 126 is in operable communication with the control tower display device 130 and the data communications link 132. The control tower processor 126 is coupled to receive various types of data from the databases 128, and is operable to supply appropriate display commands to the control tower display device 130 that cause the control tower display device 130 to render various images. Though not shown in FIG. 1, it will be appreciated that the control tower processor 126 may additionally be coupled to receive various data from one or more other external systems.

The control tower processor 126 may include one or more microprocessors, each of which may be any one of numerous known general-purpose microprocessors or application specific processors that operate in response to program instructions. In the depicted embodiment, the control tower processor 126 includes RAM (random access memory) 138 and ROM (read only memory) 140. The program instructions that control the processor 144 may be stored in either or both the RAM 138 and the ROM 140. For example, the operating system software may be stored in the ROM 140, whereas various operating mode software routines and various operational parameters may be stored in the RAM 138. It will be appreciated that this is merely exemplary of one scheme for storing operating system software and software routines, and that various other storage schemes may be implemented. It will also be appreciated that the control tower processor 126 may be implemented using various other circuits, not just one or more programmable processors. For example, digital logic circuits and analog signal processing circuits could also be used.

The databases 128 include various types of runway status-related data. These runway status-related data include various runway related data such as, for example, runway and taxiway width and length values, positions of taxiways and runways, runway survey and geographical position data, including runway center point, runway centerline and both runway endpoints, and an open status or a closed status of each runway that may further include whether a runway is under construction or may have an obstruction or damage of some kind. It will be appreciated that the runway status information may need to be updated periodically, for example daily, to provide real-time information useful for indicating which runways may or may not be operational. It will further be appreciated that, although the databases 128 are, for clarity and convenience, shown as being stored separate from the control tower processor 126, all or portions of these databases 128 could be loaded into the RAM 138, or integrally formed as part of the control tower processor 126, and/or RAM 138, and/or ROM 140. The databases 128, or data forming portions thereof, could also be part of one or more devices or systems that are physically separate from the system 100.

The control tower display device 130 is used to display various images and data, in both a graphical and a textual format, and to supply visual feedback to the air traffic controller 122 in response to the user input commands supplied by the air traffic controller 122 to the user interface 124. It will be appreciated that the control tower display device 130 may be any one of numerous known displays suitable for rendering image and/or text data in a format viewable by the air traffic controller 122. Non-limiting examples of such displays include various cathode ray tube (CRT) displays, and various flat panel displays such as, various types of LCD (liquid crystal display) and TFT (thin film transistor) displays. The display may additionally be based on a panel mounted display, a HUD projection, or any known technology. In an exemplary embodiment, control tower display device 130 includes a panel display.

Figure 2:
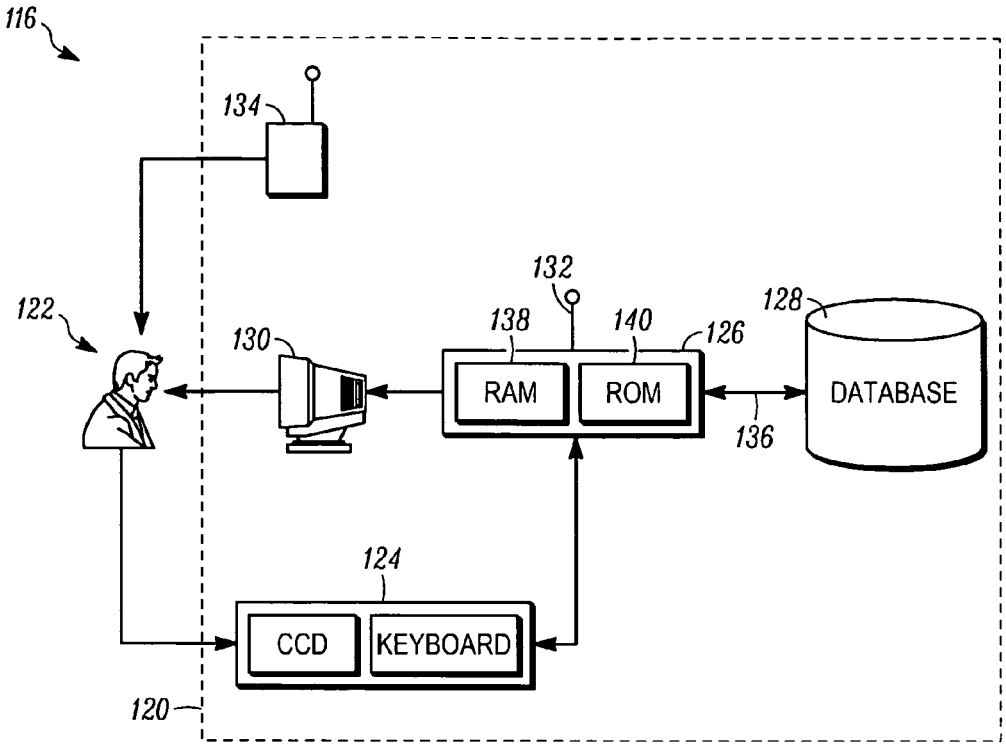
FIG. 2 is a functional block diagram of a control tower system that may be incorporated into a control tower of the system shown in FIG. 1, according to an embodiment.

The data communications link 132 is configured to send runway status-related data from the control tower system 116 to the aircraft system 118 (FIG. 1). Alternatively, the data communications link 132 may be configured to receive data from the aircraft system 118. In an embodiment, such as shown in FIG. 2, the data communications link 132 may be a transceiver that wirelessly transmits and receives the data either directly or indirectly to the aircraft system 118.

The audio communications link 134 allows the air traffic controller 122 to audibly relay information, such as an aircraft runway assignment, to an aircraft crew member. The audio communications link 134 may include a wireless radio transceiver or any other similar device capable of sending and receiving audio transmissions.

Figure 3:
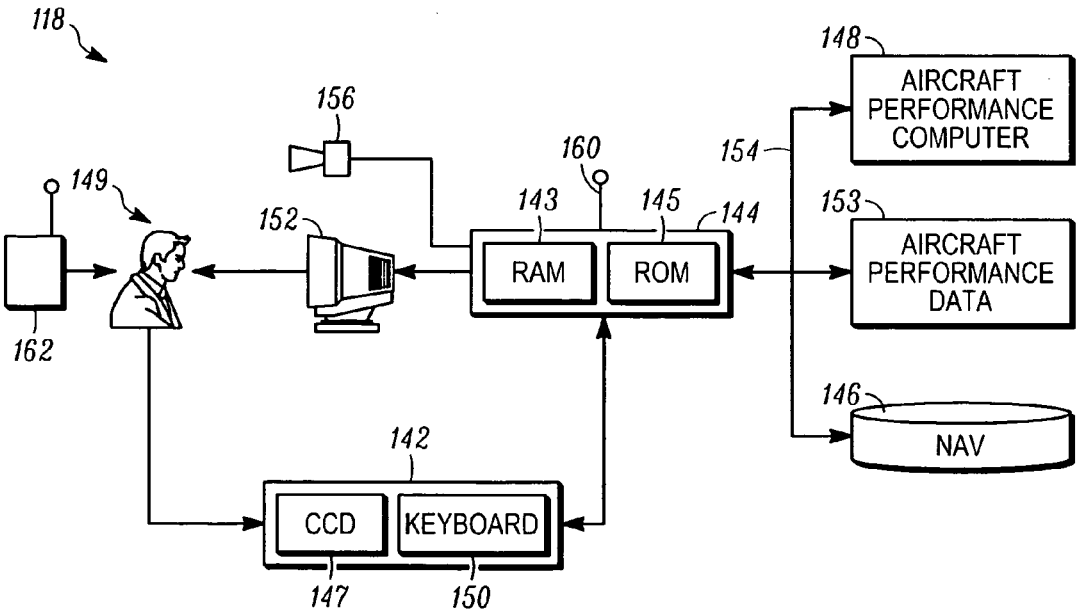
FIG. 3 is a functional block diagram of an aircraft system that may be implemented into an aircraft of the system shown in FIG. 1, according to an embodiment.

Turning now to FIG. 3, a functional block diagram of the aircraft system 118 that may be implemented into the aircraft 106 of the system 100 shown in FIG. 1, is provided according to an embodiment. The aircraft system 118 includes at least an aircraft user interface 142, an aircraft processor 144, one or more navigation databases 146, an aircraft performance computer 148, an aircraft display device 152, a data communications link 160, and an audio communications link 162. The aircraft user interface 142 is in operable communication with the aircraft processor 144 and is configured to receive input from a crew member 149 (e.g., a flight crew member) and, in response to the user input, supply command signals to the aircraft processor 144. The aircraft user interface 142 may be any one, or combination, of various known user interface devices including, but not limited to, a cursor control device (CCD), such as a mouse, a trackball, or joystick, and/or a keyboard, one or more buttons, switches, or knobs. In the depicted embodiment, the aircraft user interface 142 includes a CCD 147 and a keyboard 150. The crew member 149 uses the CCD 147 to, among other things, move a cursor symbol on the display screen, and may use the keyboard 150 to, among other things, input various data.

The aircraft processor 144 is in operable communication with the aircraft performance computer 148 via, for example, a communication bus 154. The aircraft processor 144 is also in operable communication with the aircraft display device 152 and the data communications link 160. The aircraft processor 144 is coupled to receive various types of data from the aircraft performance computer 148 and may additionally receive navigation data from one or more of the navigation databases 146, and is operable to supply appropriate display commands to the aircraft display device 152 that cause the aircraft display device 152 to render various images. Though not shown in FIG. 3, it will be appreciated that the aircraft processor 144 may additionally be coupled to receive various data from one or more other external systems. For example, the aircraft processor 144 may also be in operable communication with a source of weather data (including wind speed, wind direction, presence and location of precipitation events), a terrain avoidance and warning system (TAWS), a traffic and collision avoidance system (TCAS), an instrument landing system (ILS), and a runway awareness and advisory system (RAAS), just to name a few. If the aircraft processor 144 is in operable communication with one or more of these external systems, it will be appreciated that the aircraft processor 144 is additionally configured to supply appropriate display commands to the aircraft display device 152 so that the data supplied from these external systems may also be selectively displayed on the aircraft display device 152. In some embodiments, the aircraft processor 144 is in operable communication with an audible warning device 156, and is configured to supply sound emitting commands thereto in certain circumstances. In still other embodiments, the aircraft processor 144 is in operable communication with other aircraft components, such as a wheel lock mechanism (not shown), that may be selectively engaged.

The aircraft processor 144 may include one or more microprocessors, each of which may be any one of numerous known general-purpose microprocessors or application-specific processors that operate in response to program instructions. In the depicted embodiment, the aircraft processor 144 includes on-board RAM (random access memory) 143 and on-board ROM (read only memory) 145. The program instructions that control the aircraft processor 144 may be stored in either or both the RAM 143 and the ROM 145. For example, the operating system software may be stored in the ROM 145, whereas various operating mode software routines and various operational parameters may be stored in the RAM 143. It will be appreciated that this is merely exemplary of one scheme for storing operating system software and software routines, and that various other storage schemes may be implemented. It will also be appreciated that the aircraft processor 144 may be implemented using various other circuits, not just one or more programmable processors. For example, digital logic circuits and analog signal processing circuits could also be used.

The navigation databases 146 include various types of navigation-related data. These navigation-related data include various flight plan related data such as, for example, waypoints, distances between waypoints, headings between waypoints, navigational aids, obstructions, special use airspace, political boundaries, communication frequencies, aircraft departure and approach information, protected airspace data, and airport data related to different airports including, for example, published aeronautical data, airport maps, data on fixed airport obstacles (tower, buildings and hangars), taxiways and runways of interest, an airport designator for identifying an airport, runway and taxiway width and length values, geographical positions of taxiways and runways, runway survey data, including runway center point, runway centerline and both runway endpoints. It will be appreciated that, although the navigation databases 146 are, for clarity and convenience, shown as being stored separate from the aircraft processor 144, all or portions of these databases 146 could be loaded into the on-board RAM 143, or integrally formed as part of the aircraft processor 144, and/or RAM 143, and/or ROM 145. The navigation databases 146, or data forming portions thereof, could also be part of one or more devices or systems that are physically separate from the display system 100.

The aircraft performance computer 148 is in operable communication, via the communication bus 154, with various data sources including, for example, the navigation databases 146 and one or more sources of aircraft performance data 153, and is used, among other things, to allow the crew member 149 to selectively receive or retrieve data therefrom. The aircraft performance data 153 includes various types of performance-related data including, for example, aircraft fuel supply data, aircraft weight, passenger load data, various types of data representative of the current aircraft state, such as aircraft speed, altitude, heading, the particular aircraft category, and other types of similar data. The data is then supplied to or retrieved by the aircraft processor 144, via the communication bus 154. The aircraft processor 144 in turn processes the data to thereby supply appropriate display commands to the aircraft display device 152. It will additionally be appreciated that all or portions of the data mentioned herein may be entered manually by a user, such as the crew member 149. Moreover, it will be appreciated that the aircraft performance computer 148 may have a separate processor (not shown) that processes the aircraft performance data before it is supplied to the aircraft processor 144 or the aircraft processor 144 may be embedded within the aircraft performance computer 148 itself, or vice-versa.

The aircraft display device 152 displays various images and data, in both a graphical and a textual format, and supplies visual feedback to the crew member 149 in response to the user input commands supplied by the crew member 149 to the aircraft user interface 142. It will be appreciated that the aircraft display device 152 may be any one of numerous known displays suitable for rendering image and/or text data in a format viewable by the crew member 149. Non-limiting examples of such displays include various cathode ray tube (CRT) displays, and various flat panel displays such as, various types of LCD (liquid crystal display) and TFT (thin film transistor) displays. The display may additionally be based on a panel mounted display, a HUD projection, or any known technology. In an exemplary embodiment, aircraft display device 152 includes a panel display.

The data communications link 160 is configured to receive runway status-related data from the control tower system 116 (FIGS. 1 and 2). In an embodiment, such as shown in FIG. 3, the data communications link 160 may be a transceiver or a receiver that wirelessly receives the data either directly or indirectly from the control tower system 116. In some cases, the data communications link 160 is configured to transmit data from the aircraft system 118 to the control tower system 116.

The audio communications link 162 is used to allow the crew member 149 to audibly relay information, such as a confirmation of an audibly received aircraft runway assignment, to the air traffic controller 122. The audio communications link 162 may include a wireless radio transceiver or any other similar device capable of sending and receiving audio transmissions.

Figure 4:
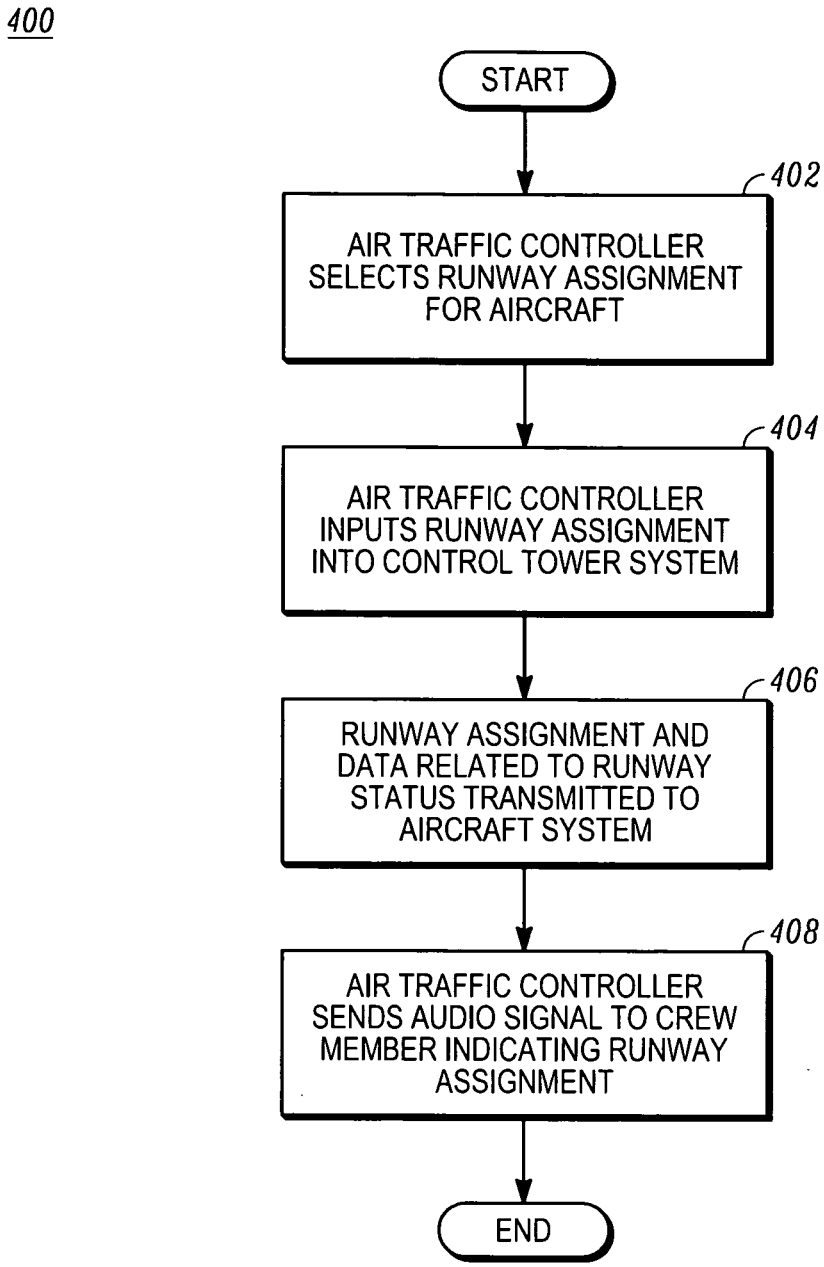
FIG. 4 is a flow diagram of a method of alerting aircraft crew members of a runway assignment for an aircraft takeoff sequence, according to an embodiment.

Having described an embodiment of the system 100 for alerting aircraft crew members of a runway assignment for an aircraft takeoff sequence, a method 400 for alerting the crew members of the runway assignment will now be discussed. The method 400, according to an embodiment, is depicted in a flow diagram in FIG. 4. With reference to FIGS. 2-4, during an aircraft takeoff sequence, an air traffic controller 122 selects a runway assignment for the aircraft 106, step 402. In an embodiment, the air traffic controller 122 may consult the control tower database 128 to determine runway statuses and/or whether an open runway has been assigned to another aircraft.

After selection, the air traffic controller 122 inputs the runway assignment into the control tower system 116, step 404, and the runway assignment and data related to runway status (such as an open or closed status for each airport runway 110, 112, 114) is transmitted to the aircraft system 118, step 406. For example, the air traffic controller 122 may use the user interface 124 to input the runway assignment. In response to the input, the control tower display device 130 may display the inputted runway assignment to the air traffic controller 122, thereby allowing the controller 122 to confirm the runway assignment before transmission to the aircraft system 118. After the air traffic controller 122 is satisfied with the runway assignment data, the air traffic controller 122 may use the user interface 124 to instruct the processor to transmit the runway assignment via the data communications link 132 to the aircraft system 118.

As briefly mentioned above, simultaneously with the runway assignment data, a data packet including data related to real-time runway status information is transmitted to the aircraft system 118. The data may include all or part of the runway status-related data stored in the control tower system database 128, such as data related to an open or closed status of each runway 110, 112, 114 at the airport 102.

Within a suitable time period of inputting the runway assignment (e.g., 30 seconds before or after the runway assignment input), an audio signal is sent to the crew member 149 indicating a runway assignment, step 408. In an embodiment, the air traffic controller 122 uses the audio communications link 134 in the control tower system 116 to communicate the runway assignment data to the audio communications link 162 of the aircraft 106.

Figure 5:
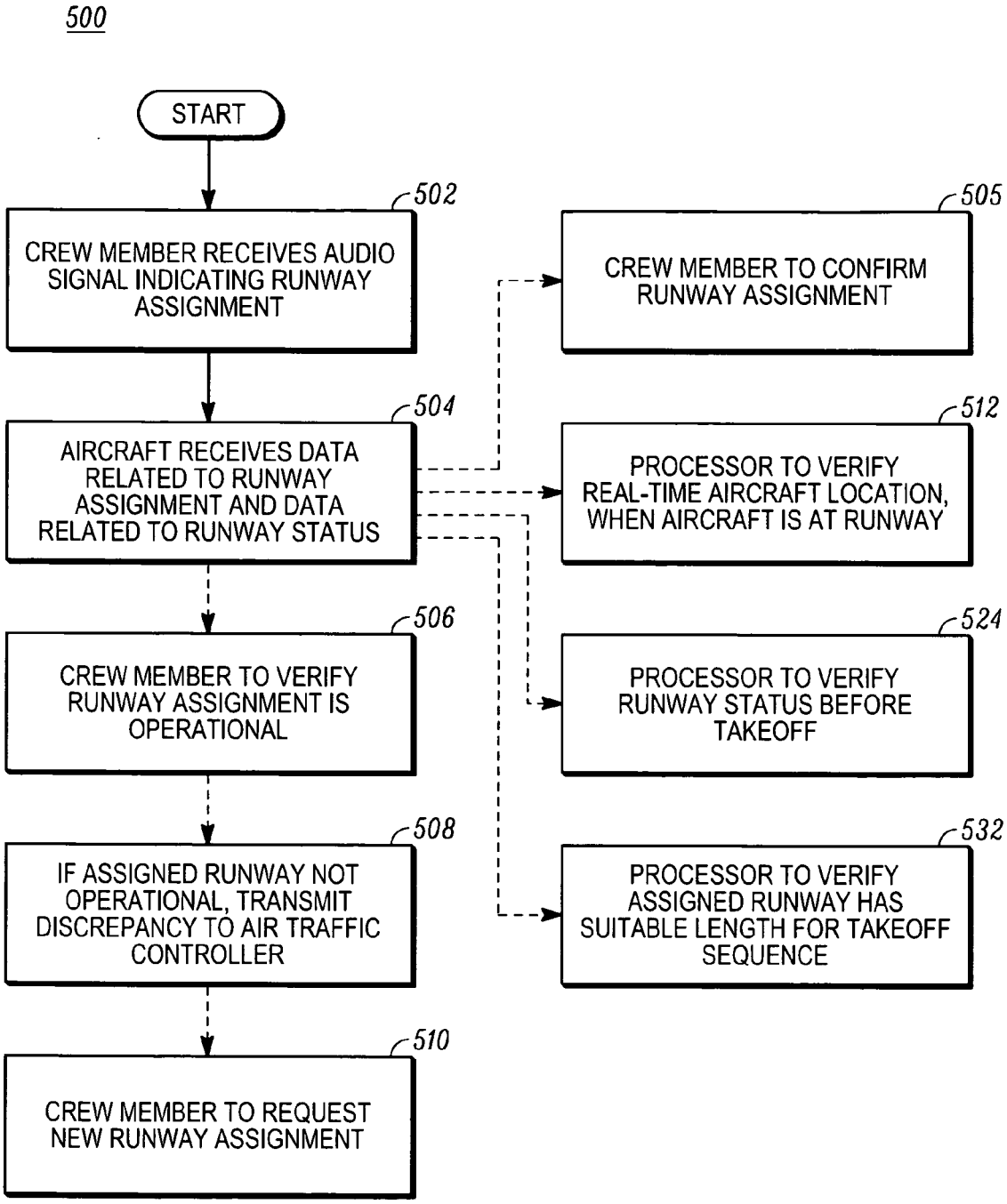
FIG. 5 is a flow diagram of a method of alerting aircraft crew members of a runway assignment for an aircraft takeoff sequence, according to another embodiment.
Figure 6:
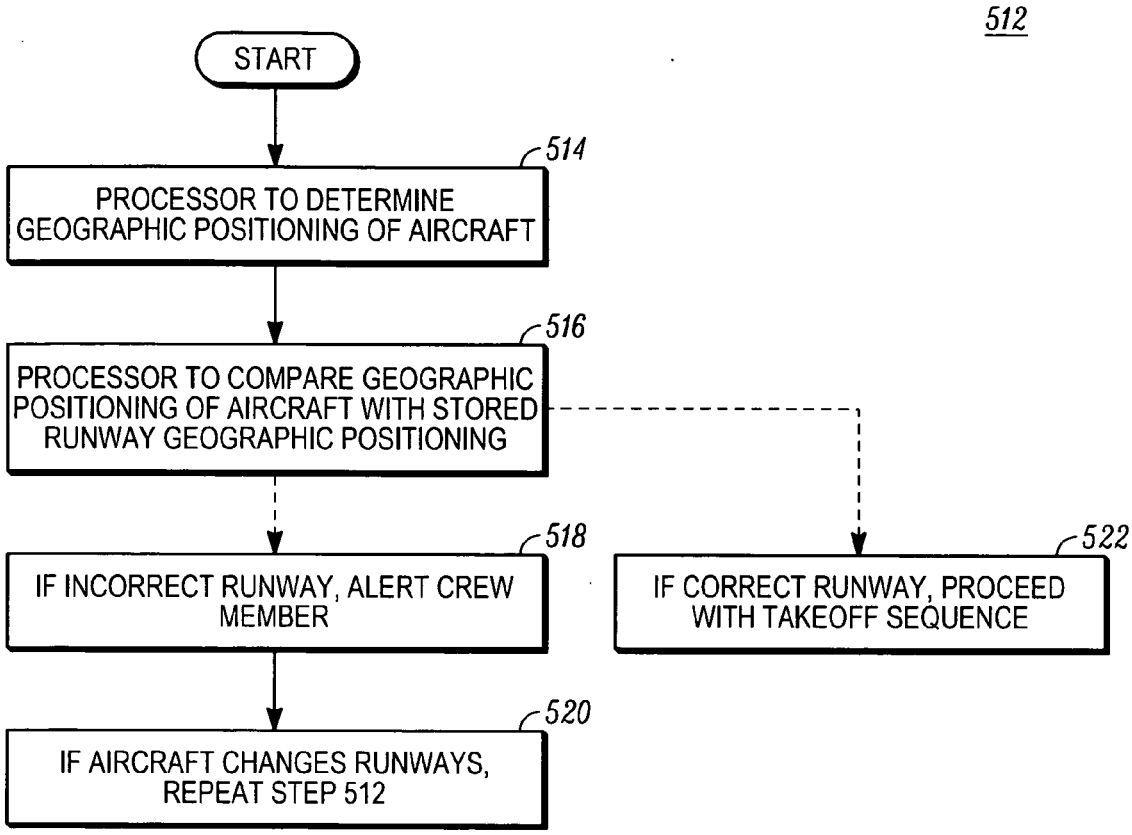
FIG. 6 is a flow diagram of a step of the method depicted in FIG. 5, according to an embodiment.
Figure 7:
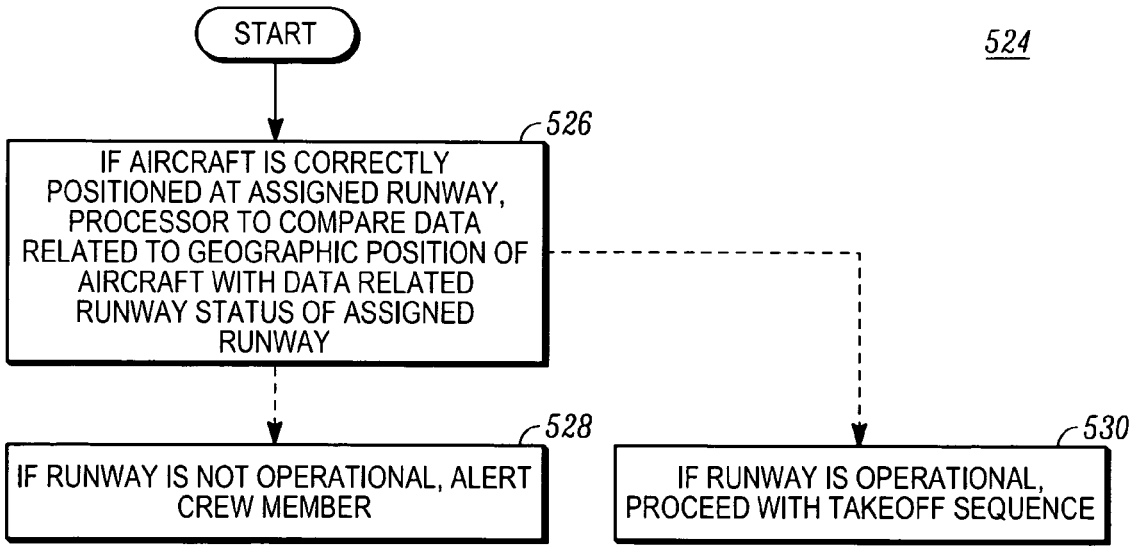
FIG. 7 is a flow diagram of another step of the method depicted in FIG. 5, according to an embodiment.
Figure 8:
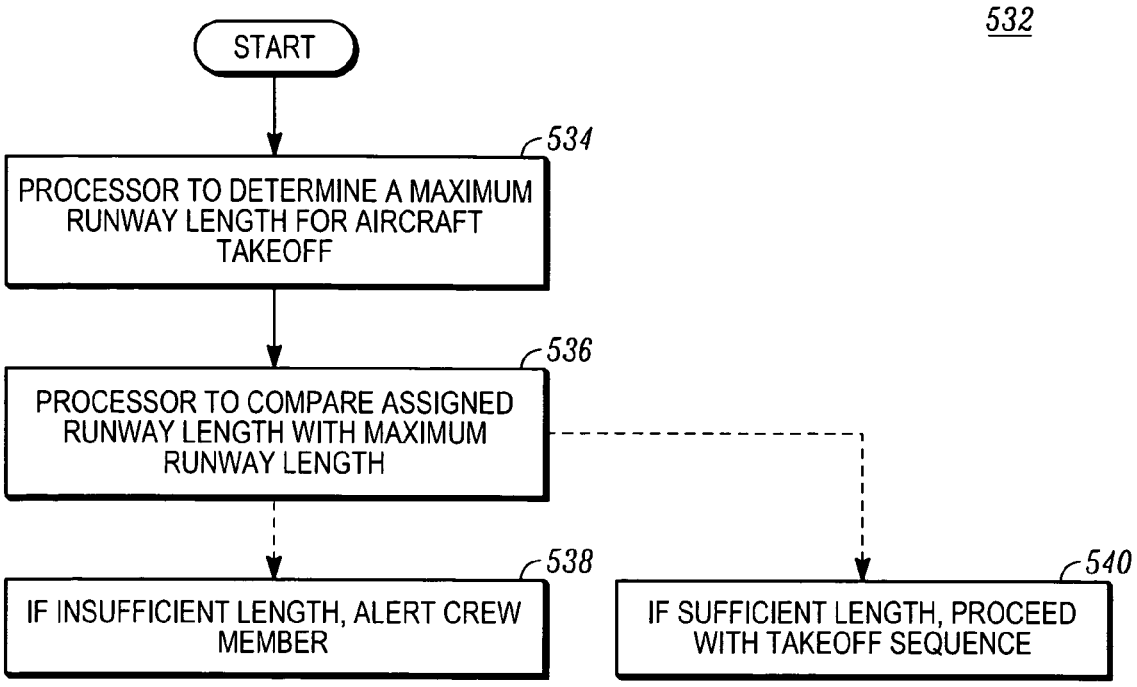
FIG. 8 is a flow diagram of still another step of the method depicted in FIG. 5, according to an embodiment.

Another method 500, according to another embodiment, is depicted in a flow diagram illustrated in FIG. 5. In this embodiment, the crew member 149 receives an audio signal indicating runway assignment via the audio communications link 162, step 502. The aircraft system 118 receives data related to the runway assignment and the runway status-related data via its data communications link 160, step 504. The aircraft processor 144, in response to the received data, renders image display commands to the aircraft display device 152 to thereby render textual and numerical graphics thereon representing the runway assignment. Additional image display commands may be communicated to the aircraft display device 152 to render textual and numerical graphics thereon representing the runway status-related data. In another embodiment, the crew member 149 may transmit data back to the control tower system 116 to confirm the runway assignment, step 505. In this regard, the crew member 149 may input data into the aircraft processor 144 via the aircraft user interface 142 indicating the confirmed runway assignment. In response, the aircraft processor 144 instructs the aircraft data communication link 160 to transmit the runway assignment data to the data communication link 134 of the control tower system 116.

In an embodiment, the crew member 149 may compare the runway assignment received via the data communications link 160 and the audio communications link 162 with the runway status-related data to verify whether the runway assigned to the aircraft 106 for takeoff is operational, step 506. Step 506 may be performed before the aircraft 106 is at its assigned runway, such as while the aircraft 106 is parked at the terminal 107, or alternatively while the aircraft 106 is on the taxiway 108. In a case in which the runway-status related data indicates that the assigned runway is not operational, the crew member 149 may transmit audio or data to the air traffic controller 122 that a discrepancy exists between the runway assignment and runway status, step 508. In this regard, the crew member 149 may input the runway status data (e.g., a closed status) into the aircraft processor 144 via the aircraft user interface 142. In response, the aircraft processor 144 instructs the aircraft data communication link 160 to transmit the runway status data to the data communication link 134 of the control tower system 116. The crew member 149 may request a new runway assignment without causing air traffic delay, step 510.

In another embodiment, the aircraft processor 144 may verify real-time aircraft location when the aircraft 106 is positioned at an endpoint of a runway, step 512. With reference to FIGS. 1-3 and 6, in one embodiment the aircraft 106 may be assigned to takeoff from runway 112. However, the crew member 149 may inadvertently maneuver the aircraft 106 to runway 110. When the aircraft 106 reaches an endpoint 170 of runway 110, the aircraft processor 144 may obtain real-time location data from position sensors to determine a geographic positioning of the aircraft 106, step 514. The aircraft processor 144 may then compare the geographic positioning of the aircraft 106 with stored runway endpoint geographic positioning data of the assigned runway to determine whether the aircraft 106 is at the correct runway 112 or an incorrect runway, step 516. If the aircraft 106 is at the incorrect runway, the aircraft processor 144 may engage a process to alert the crew member 149 of the error, step 518. For example, the aircraft processor 144 may cause the audible warning device 156 to sound a warning. Alternatively, the aircraft processor 144 may cause a wheel lock mechanism 119 to engage, thereby preventing the aircraft 106 from further movement until the crew member 149 manually disengages the wheel lock mechanism. If the aircraft 106 then changes position to runway 112, the verification step 512 may be repeated, step 520, and, if the aircraft processor 144 determines that the aircraft 106 is at the assigned runway, the aircraft 106 may proceed through the takeoff sequence, step 522.

In still another embodiment, the aircraft processor 144 may verify a runway status before takeoff, step 524. With reference to FIGS. 1-3 and 7, in one embodiment, if the aircraft processor 144 determines the aircraft 106 is correctly positioned at the assigned runway, the aircraft processor 144 may compare the data related to the geographic position of the aircraft 106 with data related to runway status of the assigned runway, step 526. If the aircraft processor 144 determines that the assigned runway is operational, the aircraft 106 may proceed through the takeoff sequence, step 528. If the assigned runway is not operational, the aircraft processor 144 may engage a process to alert the crew member 149 of the closed status of the runway, step 530. For example, the aircraft processor 144 may cause the audible warning device 156 to sound a warning. Alternatively, the aircraft processor 144 may cause a wheel lock mechanism 119 to engage, thereby preventing the aircraft 106 from further movement until the crew member 149 manually disengages the wheel lock mechanism.

In still yet another embodiment, before takeoff, the aircraft processor 144 may verify that the assigned runway has a length suitable for the takeoff sequence, step 532. For example, with reference to FIGS. 1-3 and 8, the aircraft processor 144 may determine a maximum runway length for the aircraft takeoff, based on data supplied by the aircraft performance computer 148 and navigation databases 146, step 534. The aircraft processor 144 may then compare the length of the assigned runway with the determined maximum aircraft takeoff runway length, step 536. If the runway length is insufficient for takeoff, the aircraft processor 144 may engage a process to alert the crew member 149 of the insufficiency of the runway, step 538. If the aircraft processor 144 determines that the runway length is sufficient for takeoff, the aircraft 106 may proceed through the takeoff sequence, step 540.

Systems and methods have now been provided for alerting aircraft crew members of a runway assignment for an aircraft takeoff sequence that reduces air traffic. In addition, the systems and methods are relatively simple to implement into existing systems While at least one exemplary embodiment has been presented in the foregoing detailed description of the inventive subject matter, it should be appreciated that a vast number of variations exist. It should also be appreciated that the exemplary embodiment or exemplary embodiments are only examples, and are not intended to limit the scope, applicability, or configuration of the inventive subject matter in any way. Rather, the foregoing detailed description will provide those skilled in the art with a convenient road map for implementing an exemplary embodiment of the inventive subject matter. It being understood that various changes may be made in the function and arrangement of elements described in an exemplary embodiment without departing from the scope of the inventive subject matter as set forth in the appended claims.

What is claimed is:

1. A system for alerting an aircraft crew member about a runway assignment transmitted by an air traffic control (ATC) authority for an aircraft takeoff sequence from a runway of an airport having a plurality of runways, the system configured to be disposed within the aircraft, comprising:

a processor configured to receive the runway assignment from the ATC authority and data relating to an open status or a closed status of each runway of the plurality of runways and operable, in response thereto, to supply one or more image rendering display commands.

2. The system of claim 1, wherein:

the system further comprises a user interface in operative communication with the processor, the user interface configured to receive a user input indicating receipt of the runway assignment; and the processor is further configured to receive the user input from the user interface and, in response thereto, to transmit the user input indication to a receiver.

3. The system of claim 1, wherein:

the system further comprises aircraft position sensors in operative communication with the processor, aircraft position sensors configured to sense data relating to a real-time location of the aircraft; and a wheel lock mechanism configured to engage when an incorrect aircraft position is determined, wherein the processor is further configured to receive the sensed data from the aircraft position sensors, to receive data related to runway location of the assigned runway, and to compare the sensed data and the runway location data to determine a correct aircraft position or an incorrect aircraft position and engages the wheel lock mechanism when an incorrect aircraft position is determined.

4. The system of claim 3, wherein:

the system further comprises an alert system in operative communication with the processor; and the processor is further configured to supply alert commands to the alert system when an incorrect aircraft position is determined.

5. The system of claim 3, wherein:

the processor is further configured to determine whether the assigned runway is operational, based, in part, on the data relating to the open status or closed status of each runway.

6. The system of claim 5, wherein:

the processor is further configured to supply alert commands to the alert system when a closed status of the assigned runway is determined.

7. The system of claim 6, further comprising:

a display device coupled to receive the image rendering display commands and operable, in response thereto, to (i) render an image of the data relating to the runway assignment and (ii) render an image of the data relating to the open status or the closed status of the runway of the runway assignment.

* * * * *